United States Patent [19]

May et al.

[11] 4,047,875

[45] Sept. 13, 1977

[54] INHIBITION OF CORROSION IN FUELS WITH MG/SI/MN COMBINATIONS

[75] Inventors: Walter R. May; Michael J. Zetlmeisl; Kenneth W. Koch, all of St. Louis, Mo.

[73] Assignee: Petrolite Corporation, St. Louis, Mo.

[21] Appl. No.: 634,530

[22] Filed: Nov. 24, 1975

[51] Int. Cl.[2] ..... C10L 9/00

[52] U.S. Cl. ..... 431/3; 44/4; 44/67; 44/DIG. 3; 208/47; 252/8.55 E; 252/387

[58] Field of Search ..... 431/4, 3; 44/67, DIG. 3, 44/4; 252/387, 8.55 E; 208/47; 21/2.5 R

[56] References Cited

U.S. PATENT DOCUMENTS

| | | | |
|---|---|---|---|
| 3,692,503 | 9/1972 | Kukin | 44/4 |
| 3,817,722 | 6/1974 | Scott | 44/DIG. 3 |
| 3,837,820 | 9/1974 | Kukin | 44/DIG. 3 |

*Primary Examiner*—Edward G. Favors
*Attorney, Agent, or Firm*—Sidney B. Ring; Hyman F. Glass

[57] ABSTRACT

This invention relates to the inhibition of corrosion in fuels, for example, in residual fuels, such as in those fuels used in steam boilers, process heaters and gas turbines, etc., by adding Mg/Si/Mn combinations thereto. Mg/Si/Mn combinations are not only very effective in inhibiting both corrosion and slag at high Na/V ratios but also produce other benefits including the reduction in smoke emissions when the fuel is combusted at improper fuel/air ratios.

6 Claims, No Drawings

INHIBITION OF CORROSION IN FUELS WITH MG/SI/MN COMBINATIONS

The demand for greatly increased amounts of energy has forced utilities and other large-quantity users of fossil fuels to explore low-quality fuels for use in steam boilers and gas turbines. Fuels such as unrefined crude oil and residual oil contain large amounts of impurities which result in corrosive deposits in the equipment. Two of these impurities, sodium and vanadium, form catastrophically corrosive, low melting slags that can destroy a vital part in a matter of hours.

Crude oil usually contains 1–500 ppm of vanadium in the form of a porphyrin complex depending on the source. Because of its origin as a concentrate from the refining process, residual oil contains several times more vanadium than the crude from which it was derived. The combustion of these vanadium-containing fuels produces very corrosive $V_2O_5$ deposits which can destroy a turbine part in a matter of days. Although the vanadium can be removed, the cost of the process cancels the economic advantage of using unrefined fuels. Vanadic corrosion is, therefore, usually controlled with chemical additives and optimization of operating conditions.

Sodium is almost always present in low-quality fuels, either directly in the crude oil or indirectly through contamination from various sources. The technology for removing sodium is well developed. These are limiting processes, however, and a trace of sodium must always be dealt with. In maritime use, for example, the sodium level can be increased because of the introduction of sodium chloride through the air intake and contamination of the fuel by sea water. During combustion, the sodium reacts with the sulfur in the fuel to form the sulfate which is deposited in turbine parts. This reaction has been shown to be thermodynamically favored and results in the only sodium compound that will deposit under these conditions.

The mechanism of corrosion by vanadium and sodium has received much attention. Nascent oxygen species have been proposed as the corrosive active agent in $V_2O_5$ melts. Various mechanisms have been presented to explain corrosive attack by sodium sulfate at metal surfaces. The classical method of inhibiting the corrosive characteristics of $V_2O_5$ and $Na_2SO_4$ melts has been to form high-melting vanadates of the former and minimize the level of the latter. Magnesium has been the most successful substance for this type of protection. The optimum levels of magnesium addition are not precisely known. Just as the mechanism of corrosion is only partially understood, so too is that of its inhibition.

Although magnesium-containing corrosion inhibitors are effective in reducing corrosion and producing dry friable slags when impure fuels are burnt in gas turbine and steam boilers, their effectiveness diminishes as the sodium concentration in the fuel increases. However, magnesium-silicon (Mg/Si) combinations are most effective at high Na/V ratios compared to corrosion inhibitors containing only magnesium. Stated another way, Mg/Si combinations allow a higher Na/V ratio at a given corrosion rate. In addition, Mg/Si combinations produce friable, easy-to-remove slags at higher Na/V ratios than magnesium-containing inhibitors.

The corrosion rates of materials used in gas turbine, furnace and steam boiler construction in sodium-vanadium-sulfur containing slags may be determined by a variety of methods. The most reliable method is a field test in operating equipment. However, because of the costs involved, a variety of tests have been designed to either duplicate or reflect actual field conditions. These range from high-pressure test rigs which are similar to gas turbines on a smaller scale to simple crucible tests carried out in a laboratory muffle furnace.

An electromechanical technique has been developed for measuring corrosion rates in a laboratory scale furnace that accurately reflects the situation observed in larger test facilities and in the field. This technique is described in the article "High-Temperature Corrosion in Gas Turbines and Steam Boilers by Fuel Impurities. I. Measurement of Nickel Alloy Corrosion Rate in Molten Salts by Linear Polarization Technique," by Walter R. May, et al., *Industrial and Engineering Chemistry, Product Research and Development*, Vol. II, No. 4, pg. 438, 1972. The data presented below in support of this disclosure was obtained by this technique. Good correlation has been found between data from this test and field data. Data on magnesium are published in the articles "High-Temperature Corrosion in Gas Turbines and Steam Boilers Sulfate-Vanadium Pentroxide System" and "III. Evaluation of Magnesium as a Corrosion Inhibitor," *Industrial and Engineering Chemistry*, Vol. 12, No. 2, pgs, 140–149, 1973. Data on silicon and the magnesium-silicon combination were published in the article "High Temperature Corrosion in Gas Turbines and Steam Boilers by Fuel Impurities. IV. Evaluation of Silicon and Magnesium-Silicon as Corrosion Inhibitors, "*Transactions of the ASME, Journal of Engineering for Power*, Vol. 96, 1974, pgs, 124–128. A test for evaluation of slag friability resulting from burning fuels containing these additives is given in this article.

Inhibition of corrosion and modification of slag characteristics with magnesium and silicon results from formation of compounds or dilution with metal oxides which causes higher melting ashes that are either dry and do not adhere to metal parts or do not corrode when adhered to the metal.

There are other methods of limiting corrosion and slag formation such as reducing the operating temperature and maintaining the air-to-fuel ratio so that the air/fuel ratio is very nearly stochiometric. Under such conditions, lower valence state and higher melting vanadium oxides are produced and $SO_3$ concentrations are minimized to reduce $H_2SO_4$ and $Na_2SO_4$ formation. Thus, slag modifications and corrosion inhibition are accomplished through a different mechanism from the use of additives. Manganese is a known combustion improver that will permit efficient combustion at reduced excess air levels. Increased fuel efficiency is another advantage for low air/fuel ratios.

The use of manganese for this purpose is known. For example, in the articles "Manganese Fuel Additive," by Plonski, et. al., *Diesel and Gas Turbine Programs*, November, 1974 and "Manganese Additive Reducers $SO_3$," by Belyea, *Power*, November 1966.

In order to best obtain the beneficial effects of manganese, the air/fuel ratio is maintained within very close limits. Older and poorly designed equipment will not yield the close control required to fully take advantage of the corrosion inhibition and slag control offered by manganese because of variations in the air/fuel ratio. If it is too low, incomplete combustion occurs. It it is too high, the higher valence $V^{+5}$ and $SO_3$ compounds are formed and the corrosion-slag problem occurs as if no additive were present.

One of the problems involved in adding additional metals to a metal eutectic system is the unpredictability of the effect of additional metals on the eutectic. For example, one reason for the effectiveness of Mg and Mg/Si on vanadium-containing systems is the fact that Mg and Mg/Si form a eutectic with vanadium, which, because it is higher melting, does not stick to the metal parts. Stated another way, the eutectic passes through the system without sticking to the metal and in this way corrosion is inhibited. Thus, it would be expected that the addition of Mn to the Mg/V eutectic would effect the eutectic.

In the combustion of turbine and boiler fuel it is highly desirable to control the amount of oxygen present above stoichiometric amounts so as to minimize corrosion due to the formation of oxides of sulfur and acids and salts derived therefrom and the formation of pentavalent vanadium. Since under minimum excess oxygen smoke has a tendency to form, it is desirable to suppress such smoke formation.

Although it is known that Mn is effective as a smoke inhibitor it was not known whether Mn present in the system would form a new eutectic system which would reduce Mg/Si corrosion-inhibiting effectiveness as well as the effectiveness of Mn as a smoke suppressant.

We have now discovered that Mn can be employed with Mg/Si-containing additives, even at high Na/V ratios, without adversely affecting the corrosioninhibiting eutectic.

We have further discovered that Mn does not combine in the Mg/Si system so as to adversely effect its smoke inhibiting properties, even where minimum excess oxygen is employed.

Our invention teaches the use of a superior corrosion-slag inhibitor combined with a combustion improver so that the advantages of low air/fuel ratios can be obtained along with corrosion-slag control when poor operating conditions result in uncontrolled air/fuel ratios.

Example 1

The corrosion rate of Udimet 700 was measured in several slags over a range of temperatures by the electrochemical technique described in the above cited papers. The data obtained by this procedure are given in Table I. The "Maximum Acceptable Corrosion Rate" involving corrosion rate versus temperature corresponds to a 20 mils per year corrosion rate. An acceptable life for a turbine bucket or nozzle is three years which is approximately 40 mils per year. Since our tests have an accuracy within a factor of 2, we have designated the 20 mils per year rate as our target. In terms of corrosion current as measured by our tests, this is 0.5 ma/cm$^2$. In some industrial applications, higher rates could be allowable based on economic considerations. Corrosivities based on corrosion current (I corr) for Udimet 500 tested in $Na_2SO_4$–$V_2O_5$ melts with various ratios of Mg/V, Si/V and Mn/V indicate that manganese does not adversely effect the corrosion inhibiting properties of Mg/Si combinations.

Table I

CORROSION RATES OF $Na_2SO_4$-$MgSO_4$-$SiO_2$-$MnO_2$-$V_2O_5$ SLAGS

| WEIGHT RATIOS | | | | CORROSION CURRENTS (Ma/cm$^2$) | | | | | |
|---|---|---|---|---|---|---|---|---|---|
| Na/V | Mg/V | Si/V | Mn/V | 700° | 750° | 800° | 850° | 900° | 950° |
| 1 | 2 | 2 | 1 | 1.1 | 2.8 | 4.2 | 6.1 | 8.3 | 10.2 |
| 1 | 3 | 3 | 1 | .035 | .94 | 1.8 | 2.1 | 3.6 | 7.9 |
| 1 | 2 | 2 | 2 | 1.5 | 3.1 | 4.5 | 4.8 | 6.7 | 9.0 |
| 1 | 3 | 3 | 2 | .045 | .87 | 1.4 | 1.9 | 2.8 | 6.4 |
| 1 | 2 | 2 | 3 | 1.6 | 3.5 | 3.9 | 4.4 | 6.1 | 8.7 |
| 1 | 3 | 3 | 3 | .023 | .79 | .97 | 2.3 | 4.0 | 7.3 |
| 1 | 0 | 0 | 3 | 10.62 | 13.31 | 15.87 | 17.92 | 19.97 | 25.34 |
| .1 | 2 | 2 | 1 | — | — | .036 | .056 | .101 | .244 |
| .1 | 3 | 3 | 1 | — | — | .019 | 0.23 | .033 | .075 |
| .1 | 2 | 2 | 2 | — | — | .023 | .043 | .087 | .231 |
| .1 | 3 | 3 | 2 | — | — | .006 | .010 | .020 | 0.62 |
| .1 | 2 | 2 | 3 | — | — | .020 | 0.40 | .081 | .115 |
| .1 | 3 | 3 | 3 | — | — | .010 | 0.15 | .023 | .079 |
| .1 | 0 | 0 | 3 | .578 | .65 | .795 | 1.04 | 1.56 | 1.99 |
| .01 | 2 | 2 | 1 | — | — | .051 | .115 | .176 | .832 |
| .01 | 3 | 3 | 1 | — | — | .021 | .038 | 0.49 | .106 |
| .01 | 2 | 2 | 2 | — | — | .045 | .110 | .170 | .549 |
| .01 | 3 | 3 | 2 | — | — | .039 | .050 | .100 | .147 |
| .01 | 2 | 2 | 3 | — | — | .005 | .013 | .044 | .078 |
| .01 | 3 | 3 | 3 | — | — | .002 | .010 | .038 | 0.46 |
| .01 | 0 | 0 | 3 | 13.65 | 17.07 | 20.48 | 23.55 | 27.31 | 35.16 |

The following example cites data for an actual application of this new additive and a test of the concept of taking advantage of both inhibiting mechanisms.

Example 2

A boiler was operated for six months using a No. 6 grade fuel oil. The fuel in rate was 800 bbls/day with steam at 900° F. and 1200 psi. The air/fuel ratio varied from 2 to 20% but usually 5 to 15%. An oil-soluble additive consisting of 5% magnesium, 3% silicon and 25% manganese was used at a rate of 300 ppm. The fuel contained typically 20 ppm vanadium, 45 ppm sodium and 7 ppm lead. During operation, the emissions were 90+% Von Brand Smoke values which is essentially invisible.

At the end of six months, high-temperature corrosion was absent. A few friable, easily water washed deposits were found compared with heavy, difficult to clean deposits which had been found in prior inspections. The cold-end was essentially free of cooled-end corrosion derived from $H_2SO_4$.

In the present invention, we have discovered a combination of metals that produce friable, high-melting ashes that do not corrode or produce slags under excess air conditions while allowing smoke-free performance during operation at low-excess air ratios. In the combination prescribed by this invention, the metals do not interfere with each other in their separate functions.

The amount of Mg/Si/Mn employed will vary depending on the impurities present in the fuel. The amounts required can be calculated from the linear correlation equations and knowledge of the sodium and vanadium levels in the fuel. In practice, the weight ratios of Mg/Si can vary from (Mg + Si/V + Pb +

Na) = 0.15 to 10 but preferably from about 0.20 to 4.0. The actual levels added to a fuel can vary from about 1.0 ppm for a fuel containing 1.0 ppm V and 1.0 ppm Na to as high as 5000 ppm for a fuel containing 500 ppm V and 300 ppm Na.

The ratio of Mg to Si can vary from 0.01 to 100 but will probably be in the 0.1 to 10 range. The (Mn/Mg+Si) ratio can also vary from 0.01 to 100 but is preferably in the 0.1 to 10 range. The actual levels of Mn added to the fuel can vary from the 5 to 10 ppm range to 1000 ppm or more, but preferably about 100–500 ppm.

For the purposes of this invention, the Mg/Si/Mn combination can be added in any chemical form that will involve dispersion throughout the fuel prior to combustion. The chemicals can be in inorganic forms such as sulfates, oxides or carbonates or in organic oil soluble form.

It will be apparent that various changes and modifications may be made in this invention described herein without departing from the scope of this invention. It is intended, therefore, that all matter contained herein shall be interpreted as illustrative and not limitative.

We claim:

1. An additive composition comprising magnesium, silicon and manganese, in combination, wherein the (Mn/Mg+Si) ratio is from 0.01 to 100 and where the ratio of Mg to Si varies from 0.01 to 100.

2. A hydrocarbon fuel containing corrosive amounts of sodium, vanadium and lead, which is characterized by the presence of corrosion-inhibiting amounts of the additive composition of claim 1, said additive composition being present in an amount ranging from 1.0 ppm for a fuel containing 1.0 ppm vanadium and 1.0 ppm sodium to 5000 ppm for a fuel containing 500 ppm vanadium and 300 ppm sodium.

3. A process of inhibiting corrosion in steam boilers, process heaters, gas turbines, and the like using a hydrocarbon fuel containing sodium, vanadium and lead, which comprises combusting the hydrocarbon fuel of claim 2.

4. The process of claim 3 where the combustion is carried out at low-excess oxygen or low-excess air to fuel ratios.

5. The composition of claim 1 where the (Mn/Mg+Si) ratio is from 0.1 to 10 and the ratio of Mg to Si is from 0.1 to 10.

6. The composition of claim 2 where the amount of manganese added to the fuel is from 5 to 1000 ppm.

* * * * *

UNITED STATES PATENT AND TRADEMARK OFFICE

CERTIFICATE OF CORRECTION

PATENT NO. : 4,047,875

DATED : September 13, 1977

INVENTOR(S) : Walter R. May, Michael J. Zetlmeisl and Kenneth W. Koch

It is certified that error appears in the above-identified patent and that said Letters Patent are hereby corrected as shown below:

Column 3, lines 49 and 50, "corrosioninhibiting" should read --- corrosion inhibiting ---

Column 4, line 54, "cooled-end" should read --- cold-end ---

Column 4, line 68, and Column 5, line 1, "(Mg + Si/V + Pb + Na)" should read

--- $\frac{Mg + Si}{V + Pb + Na}$ or (Mg + Si)/(V + Pb + Na) ---

Column 5, line 9, "(Mn/Mg + Si)" should read

--- $\frac{Mn}{Mg + Si}$ or (Mn/(Mg + Si)) or Mn/(Mg + Si) ---

Column 6, line 3, "(Mn/Mg + Si)" should read --- $\frac{Mn}{Mg + Si}$ ---

Column 6, line 22, "(Mn/Mg + Si)" should read --- $\frac{Mn}{Mg + Si}$ ---

Signed and Sealed this

*Twenty-third* Day of *May 1978*

[SEAL]

*Attest:*

RUTH C. MASON
*Attesting Officer*

LUTRELLE F. PARKER
*Acting Commissioner of Patents and Trademarks*